US006881119B2

(12) United States Patent
Panec et al.

(10) Patent No.: US 6,881,119 B2
(45) **Date of Patent: *Apr. 19, 2005**

(54) ACTUATABLE TOY CONTAINING DEFORMABLE BLADDER

(75) Inventors: Don J. Panec, South San Francisco, CA (US); Scott Stillinger, Monte Sereno, CA (US); Ron LaRonge, Fairfield, CA (US)

(73) Assignee: Treasure Bay, Inc., So. San Francisco, CA (US)

( * ) Notice: Subject to any disclaimer, the term of this patent is extended or adjusted under 35 U.S.C. 154(b) by 1 day.

This patent is subject to a terminal disclaimer.

(21) Appl. No.: 10/753,982

(22) Filed: Jan. 5, 2004

(65) Prior Publication Data

US 2004/0192160 A1 Sep. 30, 2004

Related U.S. Application Data

(63) Continuation of application No. 10/047,075, filed on Jan. 14, 2002, now Pat. No. 6,672,932.

(51) Int. Cl.[7] ..... A63H 3/28
(52) U.S. Cl. ..... 446/185; 446/183; 446/221
(58) Field of Search ..... 446/220, 226, 446/176, 180, 185, 221, 183, 72, 73, 74, 76, 99, 267, 308, 309, 369, 199, 371; 473/594

(56) References Cited

U.S. PATENT DOCUMENTS

| | | | | |
|---|---|---|---|---|
| 494,410 A | | 3/1893 | Carpenter | |
| 1,196,649 A | * | 8/1916 | Bocksthler | 446/226 |
| 1,324,646 A | | 12/1919 | Clements | |
| 1,352,047 A | | 9/1920 | Boje, Jr. | |
| 1,490,614 A | | 4/1924 | Loomis | |
| 1,618,571 A | | 2/1927 | Christensen | |
| 1,806,053 A | | 5/1931 | Gallagher | |
| 2,526,619 A | | 10/1950 | Gamache | |
| 2,631,407 A | * | 3/1953 | Rempel | 446/185 |
| 2,668,394 A | * | 2/1954 | Auzin | 446/183 |
| 2,731,768 A | | 1/1956 | Harrowe | |
| 2,854,788 A | | 10/1958 | Baggott | |
| 2,960,794 A | | 11/1960 | Johns | |
| 3,153,881 A | | 10/1964 | Baulard-Cogan | |
| 3,445,955 A | | 5/1969 | Ryan et al. | |
| 3,462,876 A | | 8/1969 | Kirschenmann | |
| 3,481,070 A | | 12/1969 | Baulard-Cogan | |
| 3,600,845 A | | 8/1971 | Mendigal | |
| 3,601,923 A | * | 8/1971 | Rosenberg | 446/267 |
| 3,616,101 A | | 10/1971 | Satchell et al. | |
| 3,676,387 A | | 7/1972 | Lindlof | |
| 3,827,999 A | | 8/1974 | Crossland | |
| 3,882,631 A | | 5/1975 | Goldfarb | |
| 3,996,695 A | | 12/1976 | Sapkus et al. | |
| 4,067,138 A | | 1/1978 | Cederholm et al. | |
| 4,087,933 A | | 5/1978 | Strongin | |
| 4,124,952 A | | 11/1978 | Terzian | |
| 4,133,064 A | | 1/1979 | Petrusek | |
| 4,156,985 A | | 6/1979 | Viner | |
| 4,169,336 A | | 10/1979 | Kuhn | |

(Continued)

*Primary Examiner*—Bena B. Miller
(74) *Attorney, Agent, or Firm*—Kolisch Hartwell, P.C.

(57) ABSTRACT

A toy or article containing an elastomeric and deformable bladder therein that facilitates in actuating a component of the toy or article such as a tail or an arm when squeezed or otherwise deformed is disclosed. The actuatable toy generally comprises a deformable bladder containing a fluid substance and is deformable proximate to the actuatable component upon application of pressure thereon. In addition, the actuatable toy comprises a flexible outer covering enclosing the deformable bladder, where at least a portion of the outer covering comprises a movable material disposed proximate to the actuatable component of the toy, whereupon actuating of the movable material and deformation of the bladder facilitate actuation of the actuatable component upon application of pressure on the toy.

20 Claims, 5 Drawing Sheets

U.S. PATENT DOCUMENTS

| | | | | | |
|---|---|---|---|---|---|
| 4,188,746 | A | | 2/1980 | Wolf | |
| 4,217,725 | A | | 8/1980 | Sapkus et al. | |
| 4,236,347 | A | | 12/1980 | Fauls | |
| 4,255,894 | A | | 3/1981 | Goldfarb et al. | |
| 4,287,681 | A | | 9/1981 | Albert et al. | |
| 4,304,063 | A | | 12/1981 | Katzman et al. | |
| 4,568,298 | A | | 2/1986 | Acree | |
| 4,583,957 | A | | 4/1986 | Levy | |
| 4,618,213 | A | | 10/1986 | Chen | |
| 4,718,877 | A | | 1/1988 | Girsch et al. | |
| 4,756,529 | A | | 7/1988 | Stillinger | |
| 4,759,737 | A | | 7/1988 | Ferenczi | |
| 4,765,079 | A | | 8/1988 | Takahashi | |
| 4,944,363 | A | | 7/1990 | Osher et al. | |
| 4,952,190 | A | | 8/1990 | Tarnoff et al. | |
| 5,006,089 | A | | 4/1991 | Lee | |
| 5,026,054 | A | | 6/1991 | Osher et al. | |
| 5,033,985 | A | | 7/1991 | Nahas | |
| 5,205,774 | A | | 4/1993 | Smrt | |
| 5,338,245 | A | * | 8/1994 | Murza et al. | 446/267 |
| 5,413,331 | A | | 5/1995 | Stillinger | |
| 5,462,473 | A | | 10/1995 | Sheller | |
| 5,516,322 | A | | 5/1996 | Myers | |
| 5,518,436 | A | | 5/1996 | Lund et al. | |
| 5,557,723 | A | | 9/1996 | Holt et al. | |
| 5,577,723 | A | * | 11/1996 | DiResta et al. | 473/571 |
| 5,613,892 | A | | 3/1997 | Barton | |
| 5,848,946 | A | | 12/1998 | Stillinger | |
| 6,110,001 | A | | 8/2000 | Chae | |
| 6,174,216 | B1 | | 1/2001 | Chianese | |
| 6,176,756 | B1 | | 1/2001 | Panec | |
| 6,672,932 | B1 | | 1/2004 | Panec et al. | |

* cited by examiner

ACTUATABLE TOY CONTAINING DEFORMABLE BLADDER

RELATED APPLICATION

This application is a continuation of and claims priority to U.S. patent application Ser. No. 10/047,075, now U.S. Pat. No. 6,672,932, which was filed on Jan. 14, 2002, and the complete disclosure of which is hereby incorporated by reference for all purposes.

FIELD OF THE INVENTION

The present invention relates generally to actuatable articles, typically toys, containing an elastomeric and deformable bladder therein. More specifically, a toy or article containing an elastomeric and deformable bladder therein that facilitates in actuating a component of the toy or article such as a tail or an arm when squeezed or otherwise deformed is disclosed.

DESCRIPTION OF RELATED ART

Existing toys such as stuffed animals or toy figures typically do not have often-desired actuating mechanisms or satisfactory actuating mechanisms. For example, plus toy animals are typically filled with a filling such as polyester fiber and are non-actuating.

FIGS. 1A and 1B illustrate a conventional rubber toy 20 filled with air in its normal and popped out state, respectively. The toy is generally made of a single layer of the rubber outer material 24 that includes certain layers or appendages 22 such as the eyes, nose, and ears. In particular, the appendages 22 are designed and made to pop out as shown in FIG. 1B when a user applies pressure to the toy such as by pressing or squeezing the toy. The appendages 22 are connected to the rubber outer material 24 via extra material 26 that is made to be folded and recessed into the toy 20 in its normal state as shown hidden in FIG. 1A and that unfold and extend from the remainder of the toy 20 in the popped out state as shown in FIG. 1B. When the user presses or squeezes the toy 20, the internal pressure within the toy 20 increases, resulting in movement or expansion in areas of the rubber wall such that some or all of the appendages 22 pop out. The appendages 22 popping out creates additional volume within the toy 20 that alleviates the increased internal air pressure.

Thus, it is desirable to provide an actuatable toy that gives the toy more tactile and a more real user interaction while providing added interest for the toy. In addition, the toy is preferably is easily actuatable such that a child can easily actuate the toy without the help of an adult.

SUMMARY OF THE INVENTION

A toy or article containing an elastomeric and deformable bladder therein that facilitates in actuating a component of the toy or article such as a tail or an arm when squeezed or otherwise deformed is disclosed. It should be appreciated that the present invention can be implemented in numerous ways, including as a process, an apparatus, a system, a device, or a method. Several inventive embodiments of the present invention are described below.

The actuatable toy generally comprises an elastomeric and deformable bladder containing a fluid substance and is deformable proximate to the actuatable component upon application of pressure on the elastomeric and deformable bladder. In addition, the actuatable toy comprises a flexible outer covering enclosing the elastomeric and deformable bladder, where at least a portion of the outer covering comprises a movable material disposed proximate to the actuatable component of the toy, whereupon moving of the movable material and deformation of the bladder facilitate actuation of the actuatable component upon application of pressure on the toy. The fluid substance inside the elastomeric bladder may be a liquid such as water or oil, a gas such as air, a deformable gel, or a non-fluid material suspended in fluid. The actuatable toy may further comprise a filling disposed within the outer covering and outside of the bladder.

The bladder is deformable to facilitate actuation of the actuatable component and preferably has an elastomeric outer shell so that the bladder returns to its original or resting shape. In addition, the bladder may be layered, such as with an indentation and/or a concave undercut, proximate to the actuatable component to further facilitate actuation.

The outer covering preferably includes a fabric covering, at least a portion of which is a movable material that may be, for example, a stretchable elastomeric material such as Spandex®, a layered fabric material, a gathered fabric material, and/or a loose or excess fabric material that is optionally gathered with elastic. The movable material of the outer covering allows for expansion or deformation of the bladder into a space or volume defined by the movable material when the bladder causes, directly or indirectly, the space defined by the movable material to expand or otherwise deform, resulting in actuation of the actuatable component. The actuatable component may be a belly, a tail, a nose, a snout, a mouth, a jaw, arms, ears, and/or legs of an animal toy, for example.

According to another preferred embodiment, a method for actuating an article generally comprises applying pressure to a flexible outer covering containing a deformable bladder in which the application of pressure causes moving of a movable material of the outer covering disposed proximate to an actuatable component of the article and causes deformation of the bladder containing a fluid substance. The deformation is proximate to the actuatable component of the article and the moving and the deformation cooperate to facilitate actuation of the actuatable component.

These and other features and advantages of the present invention will be presented in more detail in the following detailed description and the accompanying figures which illustrate by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DESCRIPTION OF THE SPECIFIC EMBODIMENTS

A toy or article containing an elastomeric and deformable bladder therein that facilitates in actuating a component of the toy or article such as a tail or an arm when squeezed or otherwise deformed is disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For the purpose of clarity, details relating to technical material that is known in the technical fields related to the invention have not been described in detail so as not to unnecessarily obscure the present invention.

Figure 1A:
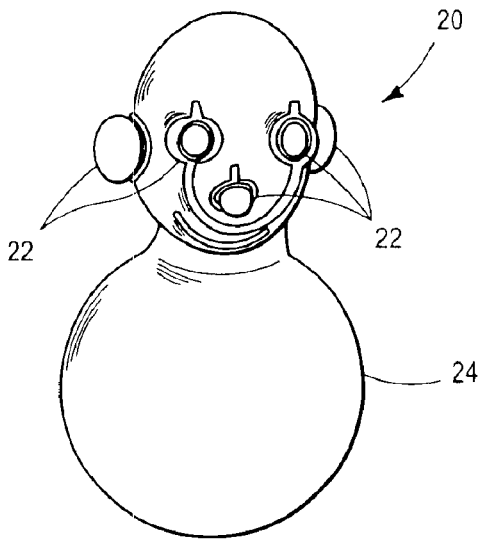
FIG. 1A Prior Art
FIGS. 1A and 1B illustrate a conventional toy in its normal and popped out state.
Figure 1B:
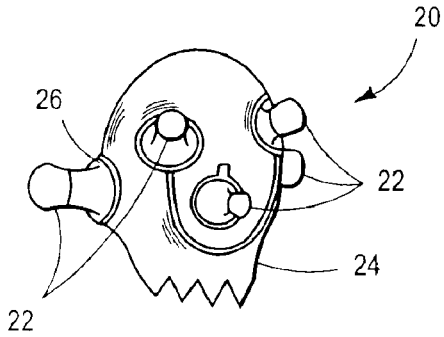
FIG. 1B Prior Art
Figure 2A:
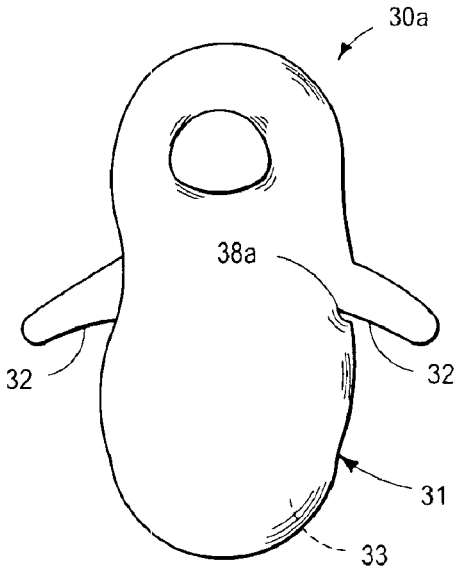
FIGS. 2A and 2B illustrate exemplary internal deformable bear bladders for placement inside a bear toy.
Figure 2B:
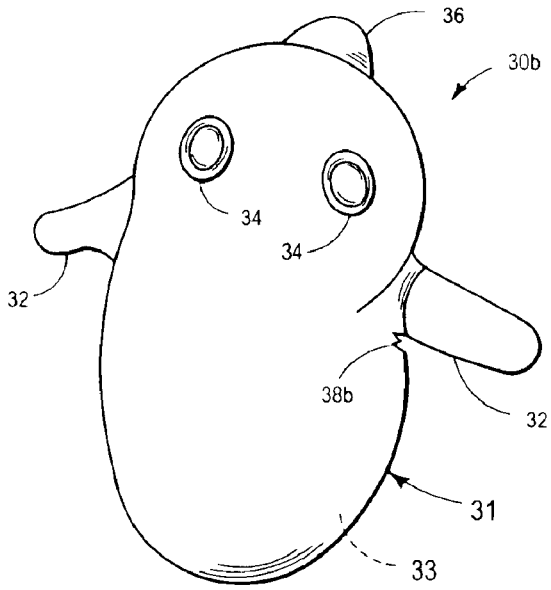

FIGS. 2A and 2B illustrate exemplary internal deformable bear bladders 30*a* and 30*b* for placement inside a bear toy. Typically, the deformable bladder 30 is squishy and preferably comprises an outer shell that is elastomeric such that the bladder generally returns to an original, resting shape upon a release of pressure. The outer shell of the deformable bladder 30 may optionally be stretchable. Inside the outer shell of the bladder, the deformable bladder 30 can be filled with a fluid substance. The fluid substance may be a liquid such as oil and water, a gas such as air, a deformable gel, and/or a non-fluid material suspended in a fluid. In one preferred embodiment, the deformable bladder 30 has an outer shell made of KRAYTON® and is filled with a mixture or combination of water and sodium polyacrylate suspended in the water. Although the bladder 30 may be filled entirely with air, it is typically less desirable as the actuation of the toy may then require increased force that may be too large for some children. However, in an alternative embodiment, the bladder may be filled partially with air.

As shown, the bear bladder 30 has arms 32, ears 34, and nose 36 that may be designed and made to selectively or collectively expand upon application of pressure to the bear bladder 30. Also shown, the arms 32 of the outer shell of the bladder 30 may be layered to allow the arms to more easily expand, extend, or otherwise be displaced upon application of pressure. In particular, FIGS. 2A and 2B illustrate two examples of layering 38*a*, 38*b* in the armpit region. Layers generally refer to layers of material or additional or excess material; folded material; indented, recessed or concave material; protruded or convex material. The layering of the outer shell of the bladder in the arms may be in portions of the arms that facilitate specific desired movement of the arms. For example, the layering of the outer shell of the bladder may only be in the front portion of the arm so as to facilitate the arms opening up. Further, the layering of the outer shell is preferably in the portion of the arm close to the torso, such as in the armpits, in order to facilitate the arms to raise relative to the torso. The arms 32 may each further define a concave undercut or indentation in or near the armpits or otherwise toward the front and lower portion of arms 32 and immediately adjacent to the torso portion of the bladder 30. The concave undercuts or indentations for the arms 32 allow the arms to flop down and forward in a normal, resting state.

Additionally or alternatively, the bladder may define layers in an area such as indented annular areas immediately around the ears 34 to allow the ears to easily extend outward. The amount of layering or indentation may be designed and made to control the amount that the ears 34 extend outward relative to the pressure applied to the bladder 30.

Application of pressure on the bladder 30 results in movement of the fluid substance in the bladder 30 and in movement or deformation of the outer elastomeric shell of the bladder 30 as the fluid substance flows within the outer elastomeric shell. In other words, the application of pressure on the bladder 30 results in an actuating or elastomeric action due to the increase in pressure inside the bladder 30 or inside portions of the bladder 30. The specific desired movement or actuation of the bladder 30 is preferably at least partially provided through the structural design of the bladder 30 and/or the elasticity and rigidity of the bladder 30. In particular, the layering and/or indentation of the arms 32, ears 34, and/or nose 36 of the bear bladder 30 are typically areas of less or least resistance to expansion or deformation of the walls of the bladder 30 and flow of the fluid substance contained therein. In other words, the bladder 30 may be made of an elastomeric material that is expandable or stretchable and the provision of the layering and/or indentations ensures that the specific desired areas of the bladder 30 expand when squeezed. As will be described in more detail below, deformation of the bladder 30 is typically also facilitated by a cover exterior to the deformable bladder.

Figure 3A:
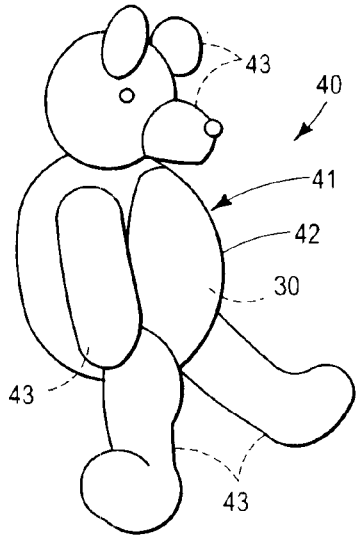
FIGS. 3A, 3B and 3C illustrate an exemplary bear toy containing the internal deformable bladder of FIGS. 2A or 2B in a stomach bulging, normal, and arms extended state, respectively.
Figure 3B:
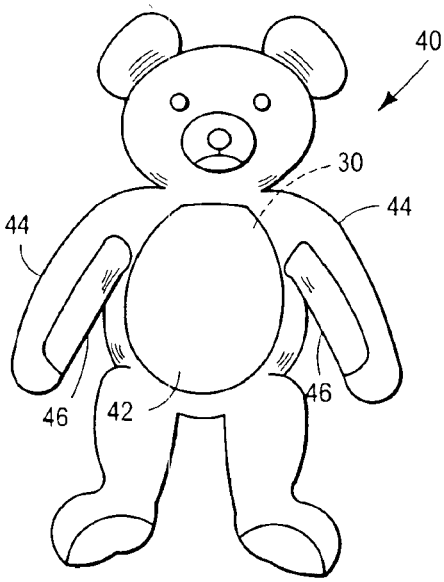
Figure 3C:
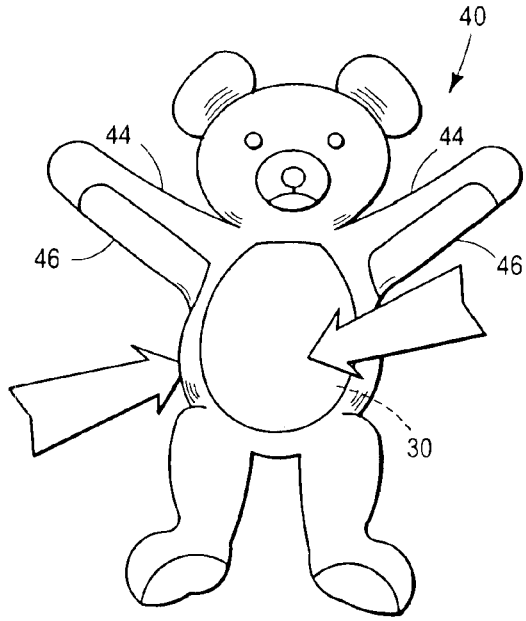

FIGS. 3A, 3B and 3C illustrate an exemplary bear toy 40 containing the internal deformable bladder 30 of FIGS. 2A and 2B in a stomach bulging, normal, and arms extended state, respectively. The bear toy 40 is typically a plush toy animal with a flexible outer covering that is typically a fabric cover such as a furry fabric to resemble the fur on a bear. In one embodiment, the flexible outer covering of the bear toy 40 contains or encloses the entire internal deformable bladder 30. However, it is noted that the flexible outer covering covers at least a portion of the internal deformable bladder 30 and need not cover the entire internal deformable bladder 30.

Typically, the bear toy 40 contains the internal deformable bladder 30 as well as some filling material such as a polyester fiber fill to fill an internal volume within the outer covering of the bear toy 40. For example, the legs, paws, the outer or distal portion of the arms, as well as portions of the nose and ears may contain the filling material. The filling material is optionally secured within the desired areas of the bear toy 40 such as by being sewn or otherwise adhered to the desired portion of the outer fabric covering and/or by placing the filling material within a wholly or partially enclosed compartment created by the outer fabric covering such as by being sewn.

The exterior cover is typically designed and implemented to cooperate with the bladder to achieve the desired specific movement or actuation of the toy. In other words, the fabric and/or other materials for the exterior cover typically also serve to extend and/or enhance the action. For example, the outer covering may provide a compartment into which the bladder may expand when pressure is applied in order to facilitate actuation of the toy. It is noted that although the exterior cover is described herein as a fabric cover, the exterior cover may be made of any suitable flexible material of combination of materials that allows the desired actuation of the article or toy.

According to a preferred embodiment, part or all of the fabric cover of the bear toy 40 comprises a movable material to facilitate actuation of the bear toy. Movable material of the exterior cover of the toy generally refers to any material that can move from a resting state to an actuated state. It is noted that the movable material may but need not be stretchable. For example, the movable material may be an elastomeric stretchable material such as Spandex®, gathered material such as loose material gathered with elastic, and/or excess material that is optionally folded or layered when it is not actuated and smoothes out at least partially when it is actuated. The folds may naturally result from excess material when the toy is in a resting or normal state. For example, when excess material is provided in an armpit of a toy, the folds in the armpit may naturally result when the arms of the toy are in a downward position due to gravity. Generally, the movable material defines a space, volume Or compartment into which the bladder may deform, i.e., a portion of the bladder may expand. The compartment typically is not a cavity when the toy is in a resting, non-actuated state. However, the compartment is such that the bladder may deform and expand into a volume created by the expanding bladder and defined by the compartment. In one example, a compartment may be formed from two generally parallel or overlapping layers of outer covering material. Thus, the compartment defined by the outer covering typically expands in volume in response to the bladder expanding into the compartment.

In the particular embodiment shown in FIGS. 3A–3C, the bear toy 40 comprises an elastomeric stretchable material that is itself stretchable over a stomach area 42 and armpit area in order to allow the toy 40 to be somewhat form fitting over the internal components, e.g., the bladder and any filling material, while allowing the bladder to expand to actuate the desired components of the toy 40. Thus, the outer covering material of the bear toy 40 defines a compartment in the stomach and armpit areas into which the deformable bladder may expand. In particular, FIG. 3B shows the bear toy 40 in a normal state, before application of pressure thereto, in which the arms 44 are generally not raised and may be drooping due to gravity. FIG. 3C shows the bear toy 40 with arms 44 open and raised. As shown, the stretchable material covers the stomach 42 and the armpits 46 such that the stomach 42 may expand or bulge and the arms may raise and/or open upon application of pressure to the bear toy 40 at the appropriate location(s).

Upon release of the pressure or squeezing of the toy 40, the portions of the toy 40 that were actuated by the application of the pressure typically returns to their normal or resting positions and/or shape. When the squeezing pressure is partially released or partially applied, the toy may be in a partially actuated state or shape.

As is evident, the exterior cover of the bear toy 40 at least partially conceals the bladder and its associated actions. Such concealment typically increases the interest level of the toy as the actuation may appear to be more of a mystery and/or come as a surprise to the user. It is noted that because the exterior fabric cover is made to be actuated by having a movable fabric over or near the desired actuating locations such as a stretchable elastomeric material and/or by having extra material that may be gathered in layers or folds, for example, the interior bladder need not have appendages. In addition, the bladder is also typically sufficiently flexible and elastomeric to deform as desired without appendages. In one embodiment, the bladder is spherical in shape and pressure can be selectively applied thereto to cause desired deformation and thus actuation. Further, the outer elastomeric shell of the bladder may be of uniform thickness, of varying thickness, and/or include ribs in order to facilitate desired deformation and actuation.

Typically, the movable material of the exterior cover is disposed proximate to the actuatable component of the toy, such as the belly, ears, and/or arms. In addition, deformation of the deformable bladder is also typically proximate to the actuatable component of the article. The actuating of the exterior cover and the deformation of the bladder into the compartment defined by the movable exterior cover combine to facilitate actuation of the actuatable component.

Although not shown, squeezing of the bear toy 40 may additionally or alternatively result in a wiggling or other movement of the ears of the bear. Preferably, the ear portions of the bladder would expand toward and/or into a compartment in the ear portion defined by the exterior fabric cover. For example, the outer covering of the bear toy 40 may be made so that the ears are folded down in its non-actuated, resting state due to gravity. When the ears are actuated, the bladder expands into a compartment in or near the ears defined by the exterior fabric cover. When pressure on the bear toy 40 is released, the eats preferably return to their resting state such that the ears fold back down to their non-actuated, resting state due to gravity.

The bear toy described above is only one example of a toy comprising a deformable bladder and an exterior covering. A deformable bladder and an exterior covering may be designed and made into any desired shape and to achieve any suitable actuation(s). Other examples include a dog toy having actuatable ears that may point and a tail that may wag, a penguin toy having actuatable arms that may flap, and a turtle toy having actuatable head and/or legs that may extend out from its shell. Other examples are shown and described with reference to FIGS. 4A–8 below.

Figure 4A:
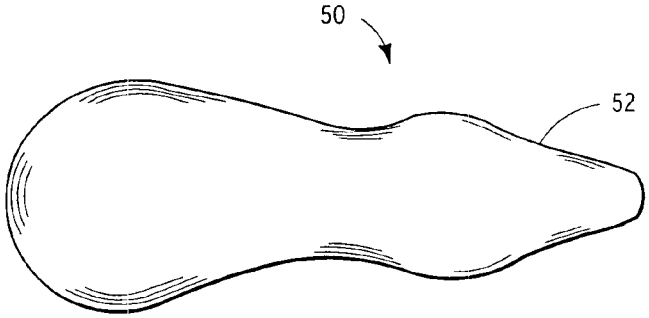
FIGS. 4A and 4B are a top and side view of an exemplary internal deformable alligator bladder for placement inside an alligator toy in a normal and a jaw extended state, respectively.
Figure 4B:
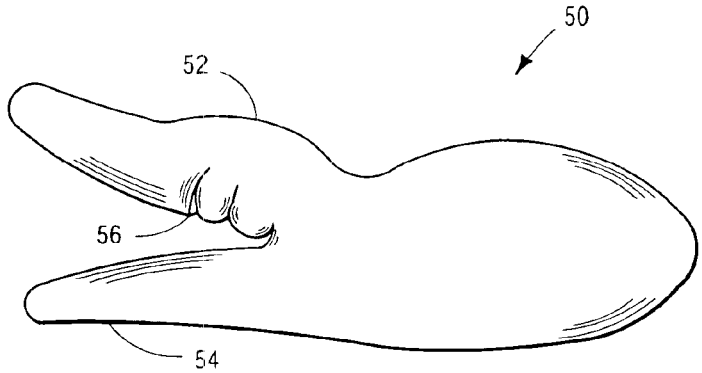
Figure 5A:
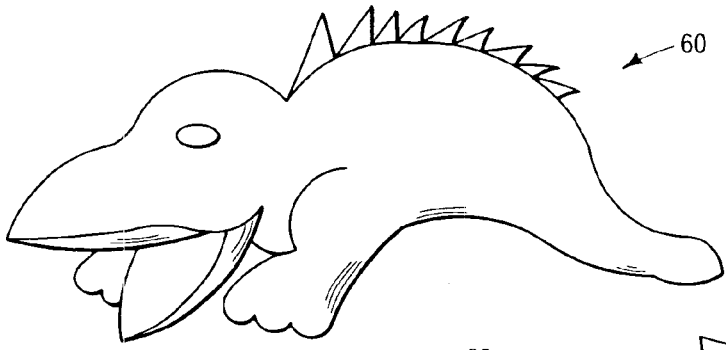
FIGS. 5A and 5B illustrate an exemplary alligator toy containing the internal deformable alligator bladder of FIGS. 4A and 4B in a normal and a jaw extended state, respectively.
Figure 5B:
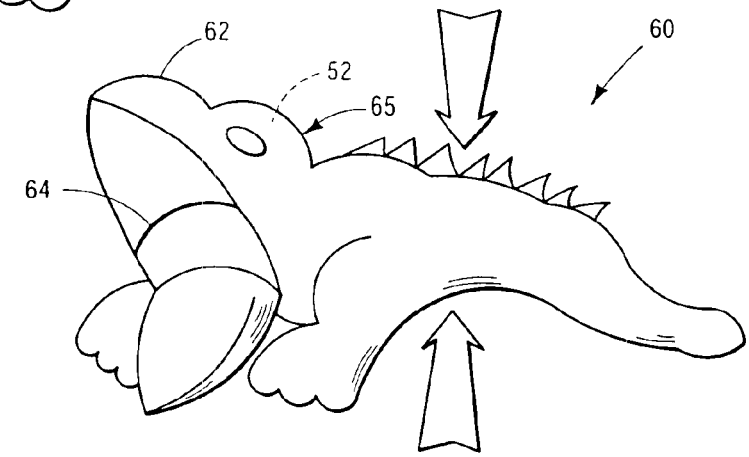

FIGS. 4A and 4B are a top and side view of an exemplary internal deformable alligator bladder 50 for placement inside an alligator toy in a normal and a jaw extended state, respectively. FIGS. 5A and 5B illustrate an exemplary alligator toy 60 containing the internal deformable alligator bladder 50 of FIGS. 4A and 4B in a normal and a jaw extended state, respectively.

As shown, the deformable alligator bladder 50 is shaped to have an upper jaw portion 52 and a lower jaw portion 54. In one preferred embodiment, a lower surface of the upper jaw portion 52 defines layers or folds 56 such that when pressure is applied to the alligator bladder 50, the layers 56 facilitate in actuating the upper jaw portion 52 to move upward, causing an opening of the alligator jaw. As shown in FIG. 5B, an upper jaw portion 62 of the alligator toy 60 is actuated upward upon application of pressure to the alligator toy 60. In this particular embodiment, an exterior cover for an underside of the upper jaw portion 62 has a movable material 64 that contains excess material such that the excess material smoothes out when the upper jaw portion 62 of the alligator toy 60 is actuated as shown in FIG. 5B. The excess material may be, for example, gathered when the alligator toy 60 is in the resting or non-actuated state as shown in FIG. 5A.

Figure 6A:
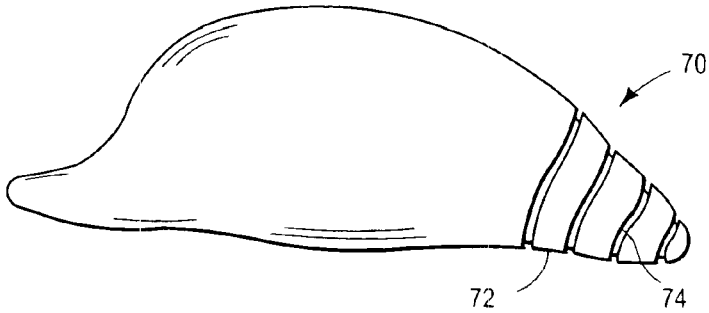
FIGS. 6A and 6B are side and bottom views, respectively, of an exemplary internal deformable dolphin bladder in a normal state for placement inside a dolphin toy.
Figure 6B:
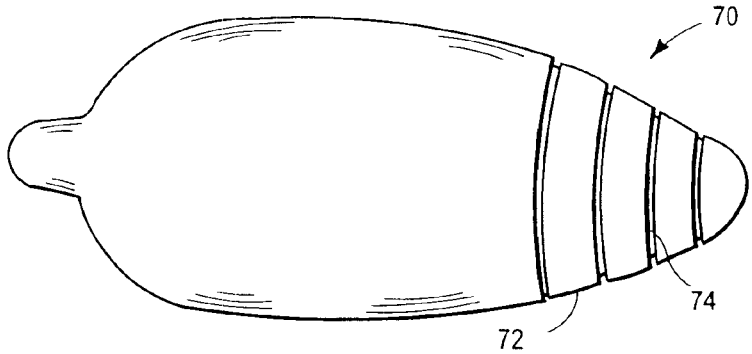
Figure 7A:
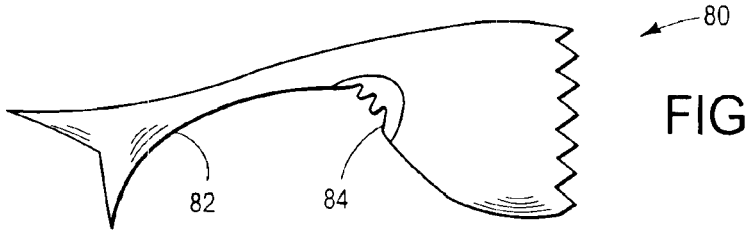
FIGS. 7A and 7B illustrate an exemplary dolphin toy containing the internal deformable dolphin bladder of FIGS. 6A and 6B in a normal and a tail flapped state, respectively.
Figure 7B:
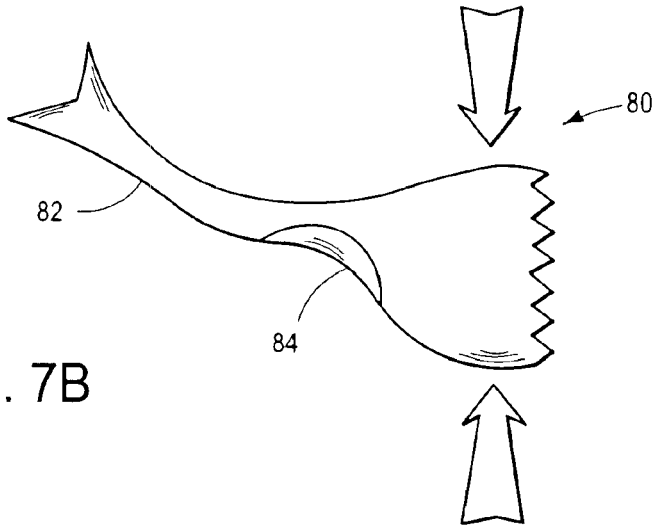

Another example of a toy comprising a deformable bladder and an exterior covering is shown in FIGS. 6A–7B. FIGS. 6A and 6B are side and bottom views, respectively, of an exemplary internal deformable dolphin bladder 70 for placement inside a dolphin toy in a normal state. FIGS. 7A and 7B illustrate an exemplary dolphin toy 80 containing the internal deformable dolphin bladder 70 in a normal and a tail flapped state, respectively.

As shown, the deformable dolphin bladder 70 may be shaped to have a tail 72 having layers 74. The tail 72 is preferably more layered on an underside of the tail 72 such that when pressure is applied to the dolphin bladder 70, the layers 74 of the tail 72 facilitate in actuating the tail 72 to move upward. As shown in FIG. 7B, a tail 82 of the dolphin toy 80 is actuated upward upon application of pressure to the dolphin toy 80. With repeated application and releasing of pressure to the dolphin toy 80, the tail can be caused to flap up and down. In the embodiment shown, the exterior cover for an underside of the tail 82 comprises a movable material 84 that contains excess material such that the excess material 84 smoothes out when the tail 82 of the dolphin toy 80 is actuated as shown in FIG. 7B. The excess material 84 may be, for example, gathered when the dolphin toy 80 is in the resting or non-actuated state as shown in FIG. 7A.

Figure 8:
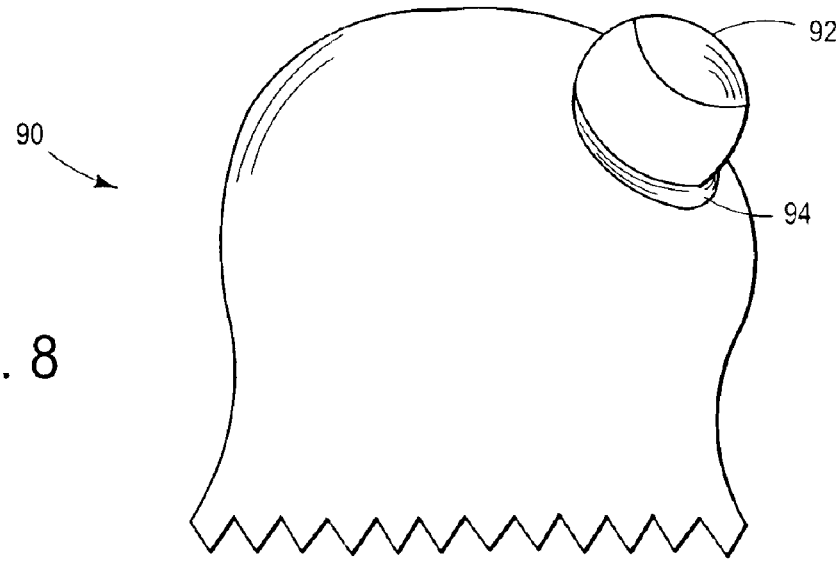
FIG. 8 illustrates an exemplary internal deformable pig bladder for placement inside a pig toy.

FIG. 8 illustrates an exemplary internal deformable pig bladder 90 for placement inside a pig toy (not shown). As shown, the pig bladder 90 has an actuatable snout 92 that can be actuated to extend and/or turn upward. The snout 92 of the pig bladder 90 defines an undercut 94 designed to cause the snout to move upward and out when the bladder 90 is squeezed. As the undercut 94 is concave, the snout 92 has a tendency to pop out with more of a sudden movement, creating a surprise for the user. Preferably, an exterior fabric covering for the corresponding pig toy is loose or otherwise movable in the area of the undercut below the snout 92. In addition, seams for the exterior fabric covering at the top and/or sides of the snout preferably limits movement such that the snout movement pivots or angles upward. Although not shown, an exterior cover proximate to an underside portion of the snout 92 preferably includes a movable material that contains excess material such that the excess material smoothes out when the snout 92 of the bladder 90 is actuated. The excess material may be, for example, gathered when the pig toy is in the resting or non-actuated state.

Figure 9:
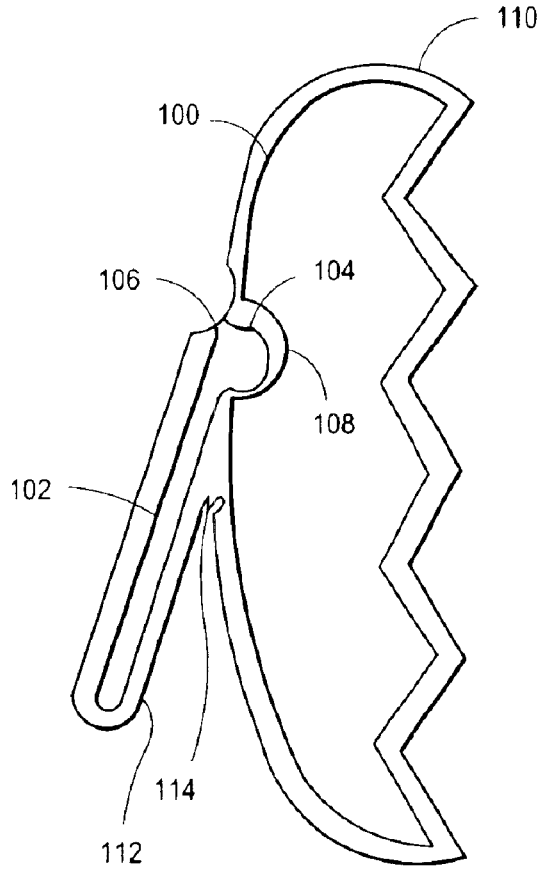
FIG. 9 illustrates exemplary internal components for placement inside an outer covering of a toy.

FIG. 9 illustrates exemplary internal components for placement inside an outer covering 110 of a toy, such as a penguin (only partially shown). In particular, a bladder 100 and a ridge piece 102 may be placed inside a wing 112 of the outer covering 110 in addition to any filling material. The rigid piece 102 may be positioned inside each wing 112 of the penguin toy to facilitate actuation of the penguin wing 112. The rigid piece 102 is preferably made of plastic but may be made of any other suitable material such as metal or wood. The rigid piece 102 may extend at least a portion of the length of the wing 112. The rigid piece 102 terminates at one end with a convex shape 104, such as a convex hemispherical shape, near or within the penguin torso. The convex shape 104 is preferably secured or attached by any suitable mechanism to the outer covering of the toy so as to ensure that the rigid piece 102 does not shift excessively from its desired position inside the toy. The point 106 at which the convex shape 104 of the rigid piece 102 is attached to the outer covering of the toy preferably protrudes from the convex shape 104 and is preferably also a pivot point about which the rigid piece 102 rotates in order to actuate the wings.

In addition, the convex shape 104 is such that the bladder 100 when deformed would expand and press against the convex shape 104 to cause a desired actuation such as a flapping of the penguin wings. A cooperating concave indentation 108, such as a cooperating hemispherical concave indentation, may be defined by the bladder 100 for receiving the convex hemispherical shape 104 of the rigid piece 102 to facilitate the actuation and to further facilitate in maintaining the rigid piece 102 in its desired position. Thus, when pressure is applied to the bladder 100, the rigid piece 102 pivots about the attachment point 106, similar to a lever arm, causing the wing to flap up accordingly. As is evident, any other suitable material may be placed within the outer covering along with the deformable bladder to facilitate desired actuation.

An underside of the wing 112 of the outer covering 110 preferably includes a movable material 114 that contains excess material such that the excess material 114 smoothes out when the wing 112 of the penguin toy 80 is actuated as shown in FIG. 7B.

While the preferred embodiments of the present invention are described and illustrated herein, it will be appreciated that they are merely illustrative and that modifications can be made to these embodiments without departing from the spirit and scope of the invention. For example, various other configuration is may be implemented utilizing a deformable bladder inside an exterior covering. Thus, the invention is intended to be defined only in terms of the following claims.

We claim:

1. A stuffed toy, comprising:

a flexible, soft outer covering defining at least a primary internal compartment, wherein the outer covering defines a central body region containing at least a substantial portion of the primary internal compartment, and further wherein the outer covering further defines at least one component that extends from the central body region and is selected from the group consisting of at least one of a head, an arm, a leg, a fin, a tail, a mouth, an ear, and a nose; and a resilient deformable bladder enclosed within the outer covering and at least substantially positioned within the primary internal compartment, wherein the bladder includes an outer shell and is filled with a fluid substance, wherein the bladder is selectively deformable between a non-actuated state and an actuated state upon application of external user-applied pressure to the body region, wherein in the non-actuated state the bladder occupies a region of the primary internal compartment and retains its shape when the external user-applied pressure is not imparted to the bladder, wherein in the actuated state the bladder extends at least proximate to at least one of the components to urge a predetermined movement of the at least one of the components from a first position that corresponds to the non-actuated state of the bladder and a second position that corresponds to the actuated state of the bladder, wherein the bladder is biased to resiliently return to the non-actuated state upon removal of the external user-applied pressure.

2. The toy of claim 1, wherein the bladder is at least substantially filled with a fluid substance other than a gas.

3. The toy of claim 1, wherein the outer shell includes at least one region of greater resistance to deformation than other regions of the outer shell, and further wherein the second position is at least partially defined by the position of the at least one region relative to the at least one of the components.

4. The toy of claim 1, wherein the outer shell includes at least one region of less resistance to deformation than other regions of the outer shell, and further wherein the second position is at least partially defined by the position of the at least one region relative to the at least one of the components.

5. The toy of claim 4, wherein the outer covering includes a region of a movable material disposed at least proximate to the at least one of the components and further wherein the second position is defined at least partially by the movable material.

6. The toy of claim 1, wherein the outer covering includes a region of a movable material disposed at least proximate to the at least one of the components and further wherein the second position is defined at least partially by the movable material.

7. The toy of claim 6, wherein the region of the movable material is adapted to have less resistance to movement than other regions of the outer covering.

8. The toy of claim 6, wherein the region of the movable material is adapted to have greater resistance to movement than other regions of the outer covering.

9. The toy of claim 1, wherein the outer covering further defines at least one secondary compartment.

10. The toy of claim 1, wherein the outer covering defines at least one secondary compartment within at least one of the at least one component.

11. The toy of claim 1, wherein the outer covering defines for each of the at least one component a secondary compartment within the at least one component.

12. The toy of claim 9, wherein the toy includes a partition separating the primary compartment from the at least one secondary compartment.

13. The toy of claim 12, wherein in the actuated state, the bladder is adapted to be urged against the partition.

14. The toy of claim 9, wherein at least one of the primary compartment and the at least one secondary compartment includes a deformable filler material.

15. The toy of claim 14, wherein at least one of the at least one secondary compartment includes a deformable filler material.

16. The toy of claim 1, wherein the primary compartment includes deformable filler material in addition to the bladder.

17. The toy of claim 1, wherein the at least one selected component includes a pair of arms, and further wherein in the second position the pair of arms are at least one of raised and spread apart relative to the first position.

18. The toy of claim 17, wherein the pair of arms take the form of a pair of wings.

19. The toy of claim 1, wherein the at least one selected component includes a tail, and further wherein in the second position the tail is at least one of raised and curled relative to the first position.

20. The toy of claim 1, wherein the at least one selected component includes a mouth, and further wherein in the second position the mouth is at least one of opened and opened wider relative to the first position.

* * * * *